United States Patent [19]

Kayukawa et al.

[11] Patent Number: 4,729,719

[45] Date of Patent: Mar. 8, 1988

[54] VARIABLE DISPLACEMENT WOBBLE PLATE TYPE COMPRESSOR WITH A WOBBLE ANGLE CONTROL UNIT

[75] Inventors: Hiroaki Kayukawa; Masaki Ohta; Akihiko Hyodo; Kenji Takenaka, all of Kariya, Japan

[73] Assignee: Kabushiki Kaisha Toyoda Jidoshokki Seisakusho, Aichi, Japan

[21] Appl. No.: 78,416

[22] Filed: Jul. 27, 1987

[30] Foreign Application Priority Data

Aug. 1, 1986 [JP] Japan ..... 61-119269

[51] Int. Cl.[4] ..... F04B 1/26

[52] U.S. Cl. ..... 417/222; 417/270

[58] Field of Search ..... 417/222, 270

[56] References Cited

U.S. PATENT DOCUMENTS

| | | | |
|---|---|---|---|
| 4,037,993 | 7/1977 | Roberts | 417/222 |
| 4,174,191 | 11/1979 | Roberts | 417/222 |
| 4,428,718 | 1/1984 | Skinner | 417/222 |
| 4,480,964 | 11/1984 | Skinner | 417/222 |
| 4,526,516 | 7/1985 | Swain et al. | 417/222 |
| 4,586,874 | 5/1986 | Hiraga et al. | 417/222 |
| 4,685,866 | 8/1987 | Takenaka et al. | 417/222 |
| 4,688,997 | 8/1987 | Suzuki et al. | 417/222 |

*Primary Examiner*—Carlton R. Croyle
*Assistant Examiner*—Paul F. Neils
*Attorney, Agent, or Firm*—Burgess, Ryan and Wayne

[57] ABSTRACT

A variable displacement wobble plate type compressor with a variable angle non-rotary wobble plate, having a suction chamber for refrigerant returning from a refrigerating circuit via an evaporator, a discharge chamber for refrigerant after compression, suction and compression cylinder bores formed in a cylinder block, pistons reciprocating in the cylinder bores, a crankcase attached to the end of the cylinder block and receiving therein a drive and a wobble plate mechanism mounted about a drive shaft connectable to a rotary drive source, connected to the pistons to cause reciprocating motion of the pistons and capable of changing the wobble angle thereof and thereby change the strokes of the pistons, a first passageway for communicating the crankcase interior chamber with a discharge chamber to supply pressure acting as a back-pressure applied to the pistons, a control valve unit for closing and opening the first passageway, a second passageway extending through the drive shaft for communicating the crankcase interior chamber with the suction chamber to enable an extraction of the refrigerant from the crankcase interior chamber into the suction chamber, via a plurality of vent holes formed in and axially separately arranged in the circumference of the drive shaft, an annular sleeve element operatively connected to the drive plate and slidable on the drive shaft to cover a variable number of the plurality of the vent holes thereby changing the amount of extraction of the refrigerant in response to a change in the cooling load.

8 Claims, 2 Drawing Figures

VARIABLE DISPLACEMENT WOBBLE PLATE TYPE COMPRESSOR WITH A WOBBLE ANGLE CONTROL UNIT

BACKGROUND OF THE INVENTION

1. Field of the Invention

The present invention relates to a variable angle wobble plate type compressor including a suction chamber, discharge chamber, and a crankcase, wherein a piston stroke is varied through a change in an inclination of the wobble plate from a fully inclined position to a substantially non-inclined position nearly vertical to a drive shaft of the compressor, which change is caused by a pressure difference between a suction pressure and a crankcase pressure. More particularly, the present invention relates to an improved wobble angle control unit for changing a compressor displacement, whereby the change in an inclination of the wobble plate is smoothly controlled from the non-inclined position to the fully inclined position.

2. Description of the Related Art

The U.S. Pat. No. 4,685,886 by K. Takenaka et al, discloses a typical variable angle wobble plate type compressor with wobble angle control unit. This compressor is applicable to a refrigerant compressor unit of, for example, an automobile air-conditioning system which includes the refrigerant compressor unit, a condenser unit, an expansion valve unit, and an evaporator unit. When the compressor is used for air-conditioning the automobile compartment, the compressor displacement can be changed in response to a change in a cooling load of the automobile compartment, to regulate the refrigerating function of the air-condition system. A typical variable angle wobble plate type compressor includes a suction chamber for a refrigerant, a plurality of cylinder bores arranged so as to surround an axial drive shaft and having therein reciprocatory pistons disposed so as to draw the refrigerant from the suction chamber and to then discharge the compressed refrigerant in the discharge chamber, a crankcase having defined therein a chamber communicating with the cylinder bores and containing therein a drive plate mounted in such a manner that it is capable of rotating with the axial drive shaft as well as changing an inclination thereof with respect to the axial drive shaft and a non-rotating wobble plate held by the drive plate, a plurality of connecting rods connecting between the wobble plate and pistons, a first passageway for communicating the crankcase chamber with the discharge chamber, a first valve unit arranged in the first passageway, for opening and closing the first passageway, a second passageway for providing a first constant fluid communication between the crankcase chamber and the suction chamber, thereby suppressing an excessive pressure rise in the crankcase chamber that might be caused by a blow-by gas leaking from the cylinder bores into the crankcase chamber, a valve control unit for controlling the operation of the first valve unit in response to a chamber in fluid pressure in the crankcase chamber with respect to a predetermined pressure level in such a manner that when a pressure in the crankcase chamber is less than the predetermined pressure level, the first valve unit is moved to a first position opening the first passageway, and when the pressure in the crankcase chamber is larger than the predetermined pressure level, the first valve unit is moved to a second position closing the first passageway, a third passageway arranged separately from the second passageway, for providing a second variable fluid communication between the crankcase chamber and the suction chamber, the third passageway including a passageway portion thereof extending axially through the drive shaft and in constant communication with the suction chamber, and an open end located in a circumference of the drive shaft so as to open toward the crankcase chamber, and an annular sleeve element slidably mounted on the drive shaft for closably opening the open end of the third passageway in direct relation to a decrease in the inclination of the drive and wobble plates from a predetermined inclined position at which the wobble plate is able to provide the pistons with the maximum reciprocatory strokes. However, in the construction of the typical variable displacement wobble type compressor, the above-mentioned open end of the third passageway extending through the drive shaft is relatively small. Also, in some cases, the open end located in the circumference of the drive shaft is disposed so as to open toward the crankcase chamber, via a tiny hole formed in one of a pair of connecting pins about which the drive plate is pivotally mounted on the sleeve element. Accordingly, the third passageway communicating between the crankcase chamber and the suction chamber is sometimes clogged with the refrigerant per se, especially when the compressor is operating at a low cooling load condition. This is because, when the cooling load is low, since the refrigerant is returned to the compressor from the air-condition circuit without a sufficient thermal exchange at the evaporator in the air-conditioning system, the refrigerant is in the liquid phase when drawn into the compressor. As a result, the liquid refrigerant becomes sticky due to the oil component contained in the refrigerant. Therefore, the sticky refrigerant is apt to stick to the wall of the third passageway and thus cause clogging. When the third passageway is clogged, the wobble angle controllability of the wobble control unit of the wobble plate type compressor must be deteriorated, even if the second passageway contributes to a suppression of an excessive rise in the pressure within the crankcase chamber.

SUMMARY OF THE INVENTION

An object of the present invention is therefore to obviate the possible inconvenience encountered by the typical variable displacement wobble plate type compressor.

Another object of the present invention is to provide an improved wobble angle control unit of a variable angle wobble plate type compressor, capable of smoothly controlling the inclination of the drive and wobble plates of the compressor, thereby precisely controlling the compressor displacement from a small displacement operation to a large displacement operation in response to a change in a cooling load of the air-conditioning system.

A further object of the present invention is to provide a novel means for preventing clogging of the internal refrigerant passageway of a variable displacement wobble plate type compressor, which can be accommodated in the existing variable displacement wobble plate type compressor.

In accordance with the present invention, there is provided a variable displacement wobble plate type compressor which comprises:

a suction chamber for a refrigerant;

a plurality of cylinder bores arranged so as to surround an axial drive shaft and having therein associated reciprocatory pistons disposed so as to draw the refrigerant from the suction chamber and to then discharge the refrigerant after compression in the discharge chamber;

a crankcase having defined therein a chamber communicating with the cylinder bores and containing therein a drive plate mounted in such a manner that it is capable of rotating with the axial drive shaft as well as changing an inclination thereof with respect to the axial drive shaft from the minimum to the maximum inclination position thereof and a non-rotating wobble plate held by the drive plate;

a plurality of connecting rods connecting between the wobble plate and pistons;

a first passageway for communicating the chamber of the crankcase with the discharge chamber;

a first valve unit arranged in the first passageway, for opening and closing the first passageway;

valve control unit for controlling the operation of the first valve unit in response to a change in fluid pressure in the chamber of the crankcase acting as a back-pressure applied to the pistons, with respect to a predetermined pressure level, the valve controlling unit moving the first valve unit to a first position opening the first passageway when pressure in the chamber of the crankcase is less than the predetermined pressure level, and to a second position closing the first passageway when the pressure in the chamber of the crankcase is larger than the predetermined pressure level;

a second passageway for providing a variable fluid communication between the chamber of the crankcase and the suction chamber, the second passageway including a portion thereof extending axially through the drive shaft and constantly communicated with the suction chamber, and a plurality of separate vent holes axially arranged in a circumference of the drive shaft so as to separately open toward the chamber of the crankcase;

an annular sleeve element axially slidably mounted on the drive shaft, and operatively connected to the drive plate so as to slide from a first position thereof covering first predetermined numbers of the plurality of the vent holes of the second passageway to a second position thereof covering second predetermined numbers of the plurality of the vent holes of the second passageway in response to a decrease in inclination of the drive and wobble plates from a predetermined inclined position whereat the wobble plate is able to provide the pistons with the maximum reciprocatory strokes, each of the first and second predetermined numbers being smaller than the total number of the plurality of the vent holes.

BRIEF DESCRIPTION OF THE DRAWINGS

The above and other objects, features and advantages of the present invention will be made more apparent from the ensuing description of the embodiments of the present invention with reference to the accompanying drawings, wherein.

DESCRIPTION OF THE PREFERRED EMBODIMENTS

Figure 1:
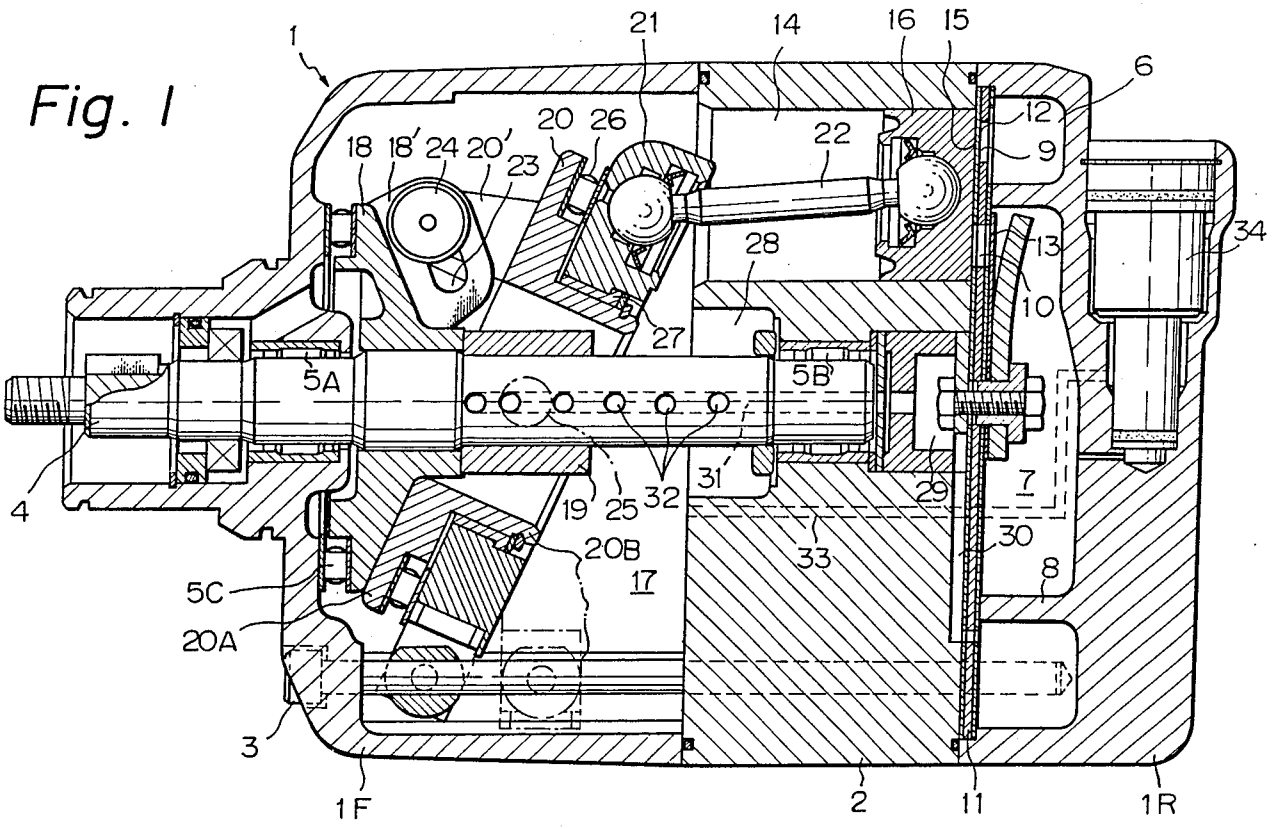
FIG. 1 is a vertical cross-sectional view of a variable displacement wobble plate type compressor with a wobble angle control unit according to a first embodiment of the present invention.

The constitution and operation of embodiments of the present invention will now be described with reference to the accompanying drawings. It should be noted that, in FIGS. 1 and 2 illustrating first and second embodiments of the present invention, identical and like parts or elements are designated by the same reference numerals.

Figure 2:
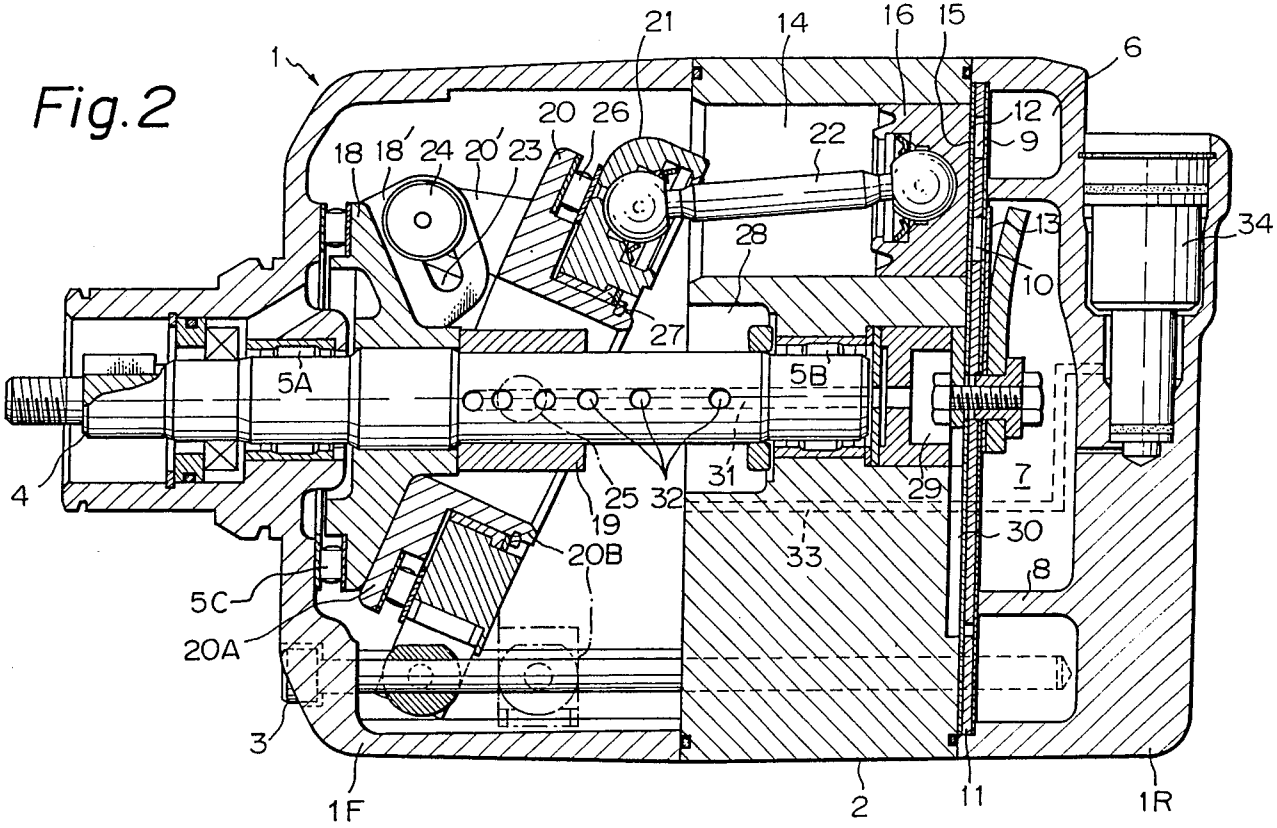
FIG. 2 is a vertical cross-sectional view of a variable displacement wobble plate type compressor with a wobble angle control unit according to a second embodiment of the present invention.

Referring to FIG. 1, which illustrates a variable displacement wobble plate type compressor with a wobble angle control unit according to a first embodiment of the present invention and applicable to an automobile air-conditioning system, a compressor body 1 has a front housing or crankcase 1F, a cylinder block 2, and a rear housing 1R airtightly combined together by an appropriate number of screw bolts 3 in an axial alignment. That is, the screw bolts 3 are inserted from angularly spaced positions of an outer periphery of the front housing 1F through the cylinder block 2 into the rear housing 1R, and are threadedly tightened by engagement of the screw ends of the screw bolts 3 and the female screw holes of the rear housing 1R. One of the screw bolts 3, which is located at the bottom position of the compressor body 1 when the compressor is mounted on the automobile, is used as a guide rod for slidably guiding a later-described non-rotating wobble plate 21.

The crankcase 1F connected to a front end of the cylinder block 2 has defined therein a crankcase chamber 17, and a central bearing bore in which a radial bearing 5A is mounted for rotatably supporting an axial drive shaft 4. The axial drive shaft 4 is also rotatably supported by another radial bearing 5B mounted in the center of the cylinder block 2.

The rear housing 1R has defined therein an outer annular suction chamber 6, and a central cylindrical discharge chamber 7 isolated from the suction chamber 6 by an annular wall 8. The suction chamber 6 of the rear housing 1R is fluidly communicated with compression chambers 15 of later-described cylinder bores 14 of the cylinder block 2, via suction ports 9 bored in a valve plate 11, and the discharge chamber 7 is also fluidly communicated with the compression chamber 15 of the cylinder bores 14 of the cylinder block 2, via discharge ports 10 bored in the same valve plate 11. The suction ports 9 of the valve plate 11 are openably closed by suction valves 12 which are opened during the suction strokes of later-described pistons 16 within the cylinder bores 14, and the discharge ports 10 are openably closed by discharge valves 13 which are opened during the delivery strokes of the pistons 16.

The cylinder block 2 has formed therein a pair of axially spaced cylindrical recesses 28 and 29 arranged axially on both sides of the radial bearing 5B. The recess 28 is formed so as to open toward the crankcase chamber 17 of the crankcase 1F, and the recess 29 is formed so as to be in constant communication with the suction chamber 6 of the rear housing 1R, via a radial passageway 30 grooved in the rear end of the cylinder block 2. At this stage, it should be understood that there is no direct communication between the two recesses 28 and 29, since an appropriate seal is provided on the rear end of the radial bearing 5B as clearly shown in FIG. 1. The cylinder bores 14 of the cylinder block 2 are circumferentially arranged around the central axis of the cylinder block 1 so as to be spaced apart from one another, and receive therein the reciprocatory pistons 16, respectively, which define the afore-mentioned compression chambers 15 on the rear side of the cylinder block 2. Thus, each of the compression chambers 15 of the cylinder bores 14 is alternately connected with the suction chamber 6 and discharge chamber 7 via the suction and discharge ports 9 and 10 in response to the reciprocating motion of the associated piston 16. The crankcase chamber 17 of the crankcase 1F which is communicated with all of the cylinder bores 14, receive therein the afore-mentioned drive shaft 4 axially arranged in the chamber 17 between the afore-mentioned pair of radial bearings 5A and 5B. An outer end of the drive shaft 4 is outwardly extended over the front end of the crankcase 1F so that it is connectable to a vehicle engine (not shown) via an appropriate transmission unit and a clutch unit. On the drive shaft 4 is mounted a drive element 18, referred to as a lug plate throughout the first and second embodiments of the present invention. The lug plate 18 having a generally round configuration is rotatably held by a thrust bearing 5C against a front inner wall of the crankcase 1F and is able to rotate with the drive shaft 4. The lug plate 18 is provided, on the inner end thereof, with an annular end face with which a later-described sleeve element 19 is able to come in contact during the large displacement operation of the compressor. The lug plate 18 is also provided, around the annular end face thereof, with an inclined end face with which a drive plate 20 is able to come in contact during the wobbling thereof, and a support arm 18' for supporting the drive plate 20.

The drive plate 20 formed as an annular member enclosing the drive shaft 4 is supported by the support arm 18' so that it is able to wobble about an axis vertical to the axis of the drive shaft 4. That is, the drive plate 20 is able to incline with respect to a plane perpendicular to the axis of the drive shaft 4. The support arm 18' is formed with an arcuate hole 23. On the other hand, the drive plate 20 has a bracket 20' extending toward and mated with the support arm 18' of the lug plate 18. The bracket 20' of the drive plate 20 and the support arm 18' are operatively connected together by a guide pin 24 fixed to the bracket 20' and movably engaged in the arcuate hole 23 of the support arm 18' so that the drive plate 20 is permitted to wobble against the lug plate 18 while rotating with the drive shaft 4. The drive plate 20 has a large-diameter disc portion 20A from which the above-mentioned bracket 20' is extended toward the lug plate 18, and a small-diameter cylindrical portion 20B extended from the disc portion 20A toward the inner end of the cylinder block 2. On the above-mentioned disc portion 20A and cylindrical portion 20B, the drive plate 20 holds a non-rotating wobble plate 21 by means of a thrust bearing 26 and a radial bearing 27. The wobble plate 21 is prevented from being rotated by the afore-mentioned guide rod in the shape of a screw bolt 3. Thus, the wobble plate 21 is permitted to carry out only a wobbling motion together with the drive plate 20 and is formed as an annular element enclosing the drive shaft 4. The non-rotating wobble plate 21 is operatively connected with the afore-mentioned respective pistons 16 by respective connecting rods 22 and ball and socket joints provided on both ends of each connecting rod 22. The connections between the wobble plate 21 and respective pistons 16 are established in such a manner that each of the pistons 16 is brought to the top dead center (i.e., the rearmost position in each cylinder bore 14) by the wobble plate 21 via the associated connecting rods 22 when the support arm 18' of the lug plate 18 is rotated to a position where the arm 18' is in axial alignment with each of the cylinder bores 14.

The sleeve element 19, which is slidably mounted on the drive shaft 4, is connected to the drive plate 20. That is, the cylindrical sleeve element 19 has a pair of diametrically opposed pivots 25 on which the smalldiameter cylindrical portion 20B of the drive plate 20 is pivotally mounted. Therefore, the sleeve element 19 is able to slide along the drive shaft 4 in association with the wobbling motion of the drive plate 20.

The axial drive shaft 4 has bored therein an axial passageway 31 extending axially from a rear end of the drive shaft 4 to an approximately middle portion of the drive shaft 4, i.e., a portion which approximately corresponds to one limiting end of the sliding movement of the sleeve element 19. The rear end of the axial passageway 31 is fluidly connected to the aforementioned recess 29, as clearly shown in FIG. 1. The drive shaft 4 also has bored therein a plurality of vent holes 32 communicating between the above-mentioned axial passageway 31 and the crankcase chamber 17. The vent holes 32 are formed as bores vertical to the axial passageway 31 and having approximately the same diameter as the axial passageway 31. Further, in the present embodiment, the vent holes 32 are arranged along an axial line on the circumference of the drive shaft 4 at an equal spacing between the two neighbouring holes 32. Thus, when the sleeve element 19 axially slides on the drive shaft 4 in response to the change in the inclination of the drive plate 20 and the wobble plate 21, some of the vent holes 32 are covered by the sleeve element 19. For example, when the sleeve 19 in the foremost position in response to the maximum inclination of the drive and wobble plates 20 and 21, the two or three foremost vent holes 32 (three in the shown embodiment) are covered by the sleeve element 19. On the other hand, one or two of the foremost vent holes 32 are uncovered when the sleeve element 19 is moved rearwardly on the drive shaft 4 in response to a decrease in the inclination of the drive and wobble plates 20 and 21. At this stage, it should be noted that at least two vent holes 32 on either the foremost side or the rearmost side are uncovered by the sleeve element 19 while the element 19 is slid on the drive shaft 4 from the foremost position to the rearmost position and vice versa. Thus, the two uncovered vent holes 32 are able to provide a fluid communication between the crankcase chamber 17 and the axial passageway 31 of the drive shaft 4, and permit a high pressure refrigerant within the crankcase chamber 17 to vent toward the suction chamber 6 of the rear housing 1R.

A pressure supply passageway 33 is extended through the cylinder block 2 and the rear housing 1R so as to provide a fluid communication between the discharge chamber 7 of the rear housing 1R and the crankcase chamber 17 of the crankcase 1F, via a control valve 34 for changing the wobble angle of the drive and wobble plates 20 and 21 by controlling a pressure level within the crankcase chamber 17; that is, when the control valve 34 is provided for opening and closing the pressure supply passageway 33 in response to a change in a cooling load in the air-conditioning circuit, i.e., a cooling load in an automobile compartment to be airconditioned. When the cooling load is large (i.e., the temperature in the automobile compartment is higher than a preset temperature value), the control valve 34 is operated to close the pressure supply passageway 33, thereby preventing a supply of the high pressure refrigerant gas from the discharge chamber 7 to the crankcase chamber 17. Thus, the pressure level within the crankcase chamber 17 is reduced to that of the suction chamber 6 of the rear housing 1R. Accordingly, a back-pressure acting on the pistons 16 is maintained at a low level, and as a result, the wobble angle of the drive and wobble plates 20 and 21 becomes large (a large displacement operation of the compressor is acquired.). On the other hand, when the cooling load in the automobile compartment is small (i.e., the temperature in the automobile compartment is lower than a preset temperature value), the control valve 34 is operated to open the pressure supply passageway 33, thereby permitting a supply of the high pressure refrigerant from the discharge chamber 7 to the crankcase chamber 17, and consequently, the wobble angle of the drive and wobble plates 20 and 21 becomes small (a small displacement operation of the compressor is acquired.). A detailed construction of the control valve 34 is described in the U.S. Pat. No. 4,685,866 hereinto incorporated by reference.

FIG. 2 illustrates the second embodiment of the present invention, which is different from the first embodiment in that the vent holes 32 are arranged along a line in the circumference of the drive shaft 4 with an unequal spacing between two neighbouring holes. That is, the spacings are gradually decreased from the rearmost side to the foremost side. The remaining construction of the compressor is the same as that of the first embodiment.

The operation of the wobble plate type compressor of the first and second embodiments of the present invention will now be described.

Referring again to FIG. 1, when the cooling load in the automobile compartment is large, the control valve 34 is operated so as to close the pressure supply passageway 33. Thus, the pressure within the crankcase chamber 17 is maintained at a level substantially corresponding to that in the pressure within the suction chamber 6 of the rear housing 1R. Therefore, the wobble plate 21 carries out a wobbling motion at a large inclination with respect to the axis of the drive shaft 4. Accordingly, the compressor of FIG. 1 operates at this large displacement. During the large displacement operation of the compressor, the sleeve element 19 is moved to the forward position thereof while covering and blocking some of the vent holes 32 which are arranged on the foremost side of the circumference of the drive shaft 4. As a result, the crankcase chamber 17 of the crankcase 1F is fluidly communicated with the axial passageway 31 of the drive shaft 4, via some of the vent holes 32 arranged on the rearside of the circumference of the drive shaft 4. Therefore, these vent holes 32 arranged on the rearside of the circumference of the drive shaft 4 act to vent a high pressure blow-by gas that flows from the cylinder bores 14 of the cylinder block 2 into the crankcase chamber 17, toward the suction chamber 6, via the axial passageway 33 of the drive shaft 4, and the recess 29 and the radial passageway 30 of the cylinder block 2. Consequently, an excessive pressure rise within the crankcase chamber 17 is avoided, and a constant pressure level (a level corresponding to a suction pressure level of the suction chamber 6) is established within the crankcase chamber 17.

On the other hand, when the cooling load in the automobile compartment is gradually decreased, the control valve 34 is operated so as to gradually open the pressure supply passageway 33. As a result, a high pressure refrigerant is supplied from the discharge chamber 7 of the rear housing 1R into the crankcase chamber 17 so that the high pressure within the crankcase chamber 17 acts on the backs of the respective pistons 16. Therefore, the wobble angle of the drive and wobble plates 20 and 21 becomes small (a small displacement operation of the compressor is acquired.). During the small displacement operation of the compressor, the sleeve element 19 is moved to the rearward position thereof while covering and blocking some of the vent holes 32 which are arranged on the rearside in the circumference of the drive shaft 4. As a result, the crankcase chamber 17 of the crankcase 1F is fluidly communicated with the axial passageway 31 of the drive shaft 4, via some of the vent holes 32 arranged on the foremost side of the circumference of the drive shaft 4. Therefore, these vent holes 32 arranged on the foremost side of the circumference of the drive shaft 4 act to vent a high pressure blow-by gas that flows from the cylinder bores 14 of the cylinder block 2 into the crankcase chamber 17, toward the suction chamber 6, via the axial passageway 33 of the drive shaft 4, and the recess 29 and the radial passageway 30 of the cylinder block 2. At this stage, it should be noted that, during the small displacement operation of the compressor, since the refrigerant returning from the air-conditioning circuit to the compressor is not completely evaporated by the evaporator of the circuit and contains a considerable amount of a liquid-state refrigerant, the liquid-state refrigerant having a sticky oil component suspended therein is liable to cause clogging of the small diameter vent holes 32 in the circumference of the drive shaft 4. However, due to provision of the plurality of vent holes 32, it is ensured that some of the plurality of vent holes 32 are not clogged by the liquid-state refrigerant. As a result, the fluid communication between the crankcase chamber 17 and the fluid circuit including the axial passageway 31, the recess 29, and the suction chamber 6 of the rear housing 1R can be maintained through the unclogged vent holes 32. Consequently, an excessive pressure rise in the crankcase chamber 17 due to the blow-by gas can be avoided (the pressure level in the crankcase chamber 17 is maintained at the level of the discharging refrigerant), and the wobble angle control of the drive and wobble plates 20 and 21 can be achieved with certainty by the wobble angle control unit including the axial passageway 31, the pressure supply passageway 33, and the control valve 34.

In the compressor of the second embodiment of FIG. 2, the vent holes 32 are arranged so that the spacings between the two neighbouring vent holes 32 are unequal, and the spacings are gradually decreased from the rearmost side to the foremost side of the plurality of vent holes 32. Therefore, the number of vent holes 32 covered by the sleeve element 19 that is moved to the rearside position thereof in response to a decrease in the inclination of the drive and wobble plates 20 and 21 caused by a reduction in the cooling load, can be smaller than that of the vent holes 32 covered by the sleeve element 19 that is moved to the foremost position thereof in response to an increase in the inclination of the drive and wobble plates 20 and 21 caused by an increase in the cooling load. This ensures the prevention of clogging of the vent holes 32 by the liquid-state refrigerant during the small displacement operation of the compressor.

As an alternative embodiment, the diameters of the vent holes 32 may be gradually increased from the one arranged on the rearmost side of the circumference of the drive shaft 4 to the one arranged on the foremost side.

From the foregoing description of the preferred embodiments of the present invention, it will be understood that, according to the present invention, the clogging of the blow-by gas relief passageway in the variable displacement wobble plate type compressor by the liquid-state refrigerant can be avoided, and the control of the wobble angle of the wobble plate is always stably accomplished over the entire range of cooling load, from a low cooling load to a large cooling load. Alternatives, variations and modifications to the described embodiments will occur to persons skilled in the art without departing from the scope and spirit of the present invention claimed in the appended claims.

We claim:

1. A variable displacement wobble plate type compressor comprising:

a suction chamber for a refrigerant;

a plurality of cylinder bores arranged so as to surround an axial drive shaft and having therein associated reciprocatory pistons disposed so as to draw the refrigerant from the suction chamber and to then discharge the refrigerant after compression in a discharge chamber;

a crankcase having defined therein a chamber communicating with the cylinder bores and containing therein a drive plate mounted in such a manner that it is capable of rotating with the axial drive shaft as well as changing an inclination thereof with respect to the axial drive shaft from the minimum to the maximum inclination position thereof, and a non-rotating wobble plate held by the drive plate;

a plurality of connecting rods connecting between the wobble plate and pistons;

a first passageway means for communicating said chamber of said crankcase with said discharge chamber;

a first valve means arranged in said first passageway means, for opening and closing said first passageway means;

valve control means for controlling the operation of said first valve means in response to a change in fluid pressure in said chamber of said crankcase acting as a back-pressure applied to said pistons, with respect to a predetermined pressure level, said valve controlling means moving said first valve means to a first position opening said first passageway means when pressure in said chamber of said crankcase is less than said predetermined pressure level, and to a second position closing said first passageway means when said pressure in said chamber of said crankcase is larger than said predetermined pressure level;

a second passageway means for providing a variable fluid communication between said chamber of said crankcase and said suction chamber, said second passageway means including a portion thereof extending axially through said drive shaft and constantly communicated with said suction chamber, and a plurality of separate vent holes axially arranged in a circumference of said drive shaft so as to separately open toward said chamber of said crankcase;

an annular sleeve element axially slidably mounted on said drive shaft, and operatively connected to said drive plate so as to slide from a first position thereof covering first predetermined numbers of said plurality of said vent holes of said second passageway means to a second position thereof covering second predetermined numbers of said plurality of said vent holes of said second passageway means in response to a decrease in inclination of said drive and wobble plates from a predetermined inclined position whereat said wobble plate is able to provide said pistons with the maximum reciprocatory strokes, each of said first and second predetermined numbers being smaller than the total number of said plurality of said vent holes.

2. A variable displacement wobble plate type compressor according to claim 1, wherein at least two of said plurality of vent holes are uncovered by said annular sleeve element while said annular sleeve element is slid from said first position thereof to said second position thereof, whereby said at least two vent holes of said second passageway means provides a predetermined constant fluid communication between said chamber of said crankcase and said suction chamber while said drive and said wobble plates change the inclination thereof from said minimum to said maximum inclination position.

3. A variable displacement wobble plate type compressor according to claim 1, wherein said plurality of vent holes are axially arranged in the circumference of said drive shaft along a line at an equal spacing between two adjacent vent holes.

4. A variable displacement wobble plate type compressor according to claim 1, wherein said plurality of vent holes are axially arranged in the circumference of said drive shaft along a line at unequal spacings between two adjacent vent holes.

5. A variable displacement wobble plate type compressor according to claim 4, wherein said unequal spacings between said two adjacent vent holes are gradually increased from a side of said first position of said annular sleeve element to a side of said second position of said annular sleeve element.

6. A variable displacement wobble plate type compressor according to claim 1, wherein each of said plurality of vent holes has a hole diameter substantially equal to a diameter of said portion of said second passageway extending axially through said drive shaft.

7. A variable displacement wobble plate type compressor according to claim 1, wherein each of said plurality of vent holes is vertical to said portion of said second passageway extending axially through said drive shaft.

8. A variable displacement wobble plate type compressor according to claim 1, wherein said second passageway means further comprises an axial recessed chamber centrally formed in said cylinder block, and a radial passageway formed in an axial end face of said cylinder block so as to be fluidly connected to said axial recessed chamber and said suction chamber.

* * * * *